US006267736B1

(12) United States Patent
McCambridge et al.

(10) Patent No.: US 6,267,736 B1
(45) Date of Patent: Jul. 31, 2001

(54) ARTICULATED MULTI-DIRECTIONAL HAND-HELD MASSAGE APPARATUS

(75) Inventors: James E. McCambridge, Polo; Gregory Wahl, Sterling, both of IL (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

(21) Appl. No.: 08/916,761

(22) Filed: Aug. 19, 1997

(51) Int. Cl.[7] ..... A61H 11/00
(52) U.S. Cl. ..... 601/74; 601/72; 601/70
(58) Field of Search ..... 601/46, 67, 69, 601/70, 72, 74, 78, 79, 80, 81

(56) References Cited

U.S. PATENT DOCUMENTS

| | | | | |
|---|---|---|---|---|
| Re. 24,630 | | 4/1959 | Wahl . | |
| D. 171,657 | | 3/1954 | McNair . | |
| D. 180,998 | | 9/1957 | Douglas . | |
| D. 191,486 | | 10/1961 | Wahl et al. . | |
| 994,270 | | 6/1911 | O'Brien et al. . | |
| 1,818,287 | | 8/1931 | Wahl . | |
| 1,918,458 | | 7/1933 | Dremel . | |
| 2,018,046 | | 10/1935 | Wilson . | |
| 2,198,442 | | 4/1940 | Oster . | |
| 2,200,635 | | 5/1940 | Oster . | |
| 2,228,934 | | 1/1941 | Tjomsland . | |
| 2,350,817 | * | 6/1944 | Purves et al. | 601/74 |
| 2,468,949 | | 5/1949 | Snyder . | |
| 2,918,055 | | 12/1959 | Boerger . | |
| 3,461,859 | * | 8/1969 | Fortnam | 601/74 |
| 5,601,529 | * | 2/1997 | Wollman | 601/74 |

FOREIGN PATENT DOCUMENTS

| | | | | |
|---|---|---|---|---|
| 3008939 | * | 10/1981 | (DE) | 601/53 |
| 1018104 | * | 12/1952 | (FR) | 601/74 |
| 486844 | | 11/1953 | (IT) . | |

* cited by examiner

*Primary Examiner*—Michael A. Brown
*Assistant Examiner*—Benjamin K. Koo
(74) *Attorney, Agent, or Firm*—Mayer, Brown & Platt

(57) ABSTRACT

Massage apparatus includes a base structure to be supported by the hand of a user. The base structure includes a first section to be positioned proximate a central portion of the hand and a second section to be positioned proximate a distal portion of the hand. The second section of the base structure is hingedly connected to the first section for articulated movement therebetween to correspond to movement of the distal portion of the hand. The base structure is a housing having first and second surfaces; a resilient pad is provided on at least one surface. Flexible members and a lip extend from the base structure to couple the user's hand with the massage apparatus. Drive motors are mounted on the second section to oscillate the base structure in at least two different directions. A controller independently controls the frequency in which the drive motors oscillate the base structure in each direction. Preferably, the controller includes a selection of resistors, although alternative driving devices and controllers may be used.

17 Claims, 5 Drawing Sheets

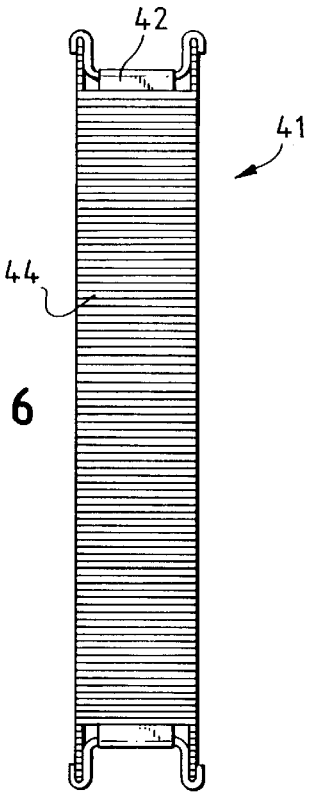
FIG. 6
FIG. 7
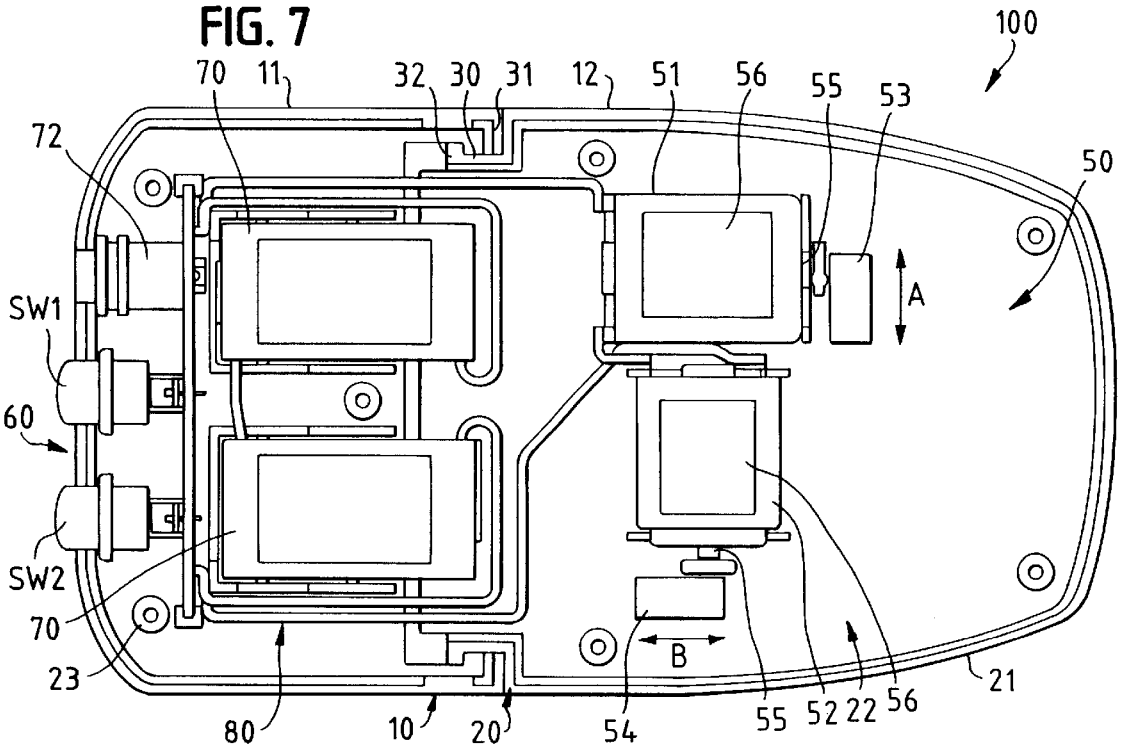

ARTICULATED MULTI-DIRECTIONAL HAND-HELD MASSAGE APPARATUS

BACKGROUND OF THE INVENTION

1. Field of the Invention

The present invention relates to a hand-held massage apparatus. Particularly, the present invention is directed to a massage apparatus capable of corresponding to the position of a user's hand. The present invention is further directed to a massage apparatus selectively capable of oscillating in a variety of different directions and at a variety of different frequencies.

2. Description of Related Art

Hand-held massage apparatus are well known and often used to improve both the depth and quality of massage applications, particular when actually using the hand and fingers to apply the massage. A primary objective of such apparatus is to increase the oscillatory movement of the user's hand relative to the recipient of the massage. Such hand-held massage apparatus therefore must be light weight and easy to handle, yet effectively transfer oscillatory movement through the user's hand.

Generally, conventional hand-held massage apparatus include a substantially rigid plate that is secured to the back of the user's hand by elastic straps or springs. A cushion often is provided to engage a continuous portion of the back of the hand, as well as the fingers. Examples of such conventional configurations are evident in U.S. Pat. Nos. 2,198,442; 2,200,635; 2,468,949 and Re. 24,630. Although this known configuration often is capable of oscillating the user's hand, the rigidity of the plate, which may or may not be contoured to fit the hand, generally restricts movement of the hand.

Alternatively, it is known to use individual pads in predetermined locations when securing a massage apparatus to the user's hand so as not to continuously engage the back of the hand and fingers. These individual pads are fixed relative to each other by a substantially rigid plate that supports the vibratory mechanism of the massage apparatus. With the individual pads in position, the massage apparatus is secured to the user's hand by elastic straps or springs. Examples of various designs employing this arrangement are presented in U.S. Pat. Nos. 1,818,287; 1,918,458 and 2,018,046. Although this arrangement allows for greater movement of the hand, the oscillations generated by the vibratory mechanism generally are impaired due to the limited surface area of the pads. Likewise, it is possible that the pads can become partially or totally disengaged from the hand during operation if not properly and securely positioned.

With regard to the mechanism used to oscillate the massage apparatus, and thus the user's hand, several constructions are known and often used. For example, one such known construction employs an electromagnet that engages an armature in response to the application of an electric current. The armature is attached to a plate or pad which, in turn, is secured to the user's hand. Vibrations therefore are transmitted through the armature to the hand. U.S. Pat. No. 1,918,458 discloses an example of this construction. This known construction, however, requires that the armature be tuned to resonate with the frequency of the electromagnet. This apparatus therefore is limited in the frequency of oscillation, as well as the direction in which the oscillation can be generated.

Another known massage apparatus uses a single electric motor having a rotatable shaft with an eccentric weight attached thereto. As the shaft rotates, the eccentric weight causes the motor to vibrate in relation to the speed of rotation. The vibrations are transmitted to the hand through a plate or pad that engages the back of the hand and fingers. A typical example of this known construction is disclosed in U.S. Pat. Nos. 994,270 and 2,018,046. Although an apparent improvement to the electromagnetic construction, this known construction only generates oscillations along the plane perpendicular to the rotatable shaft of the single motor. The use of a solenoid as an oscillating mechanism also is known, as shown by U.S. Pat. No. 2,468,949, but likewise is limited to oscillations in a single direction.

In view of the above, there remains a need for a massage apparatus capable of more adequately corresponding to the position of a user's hand. There also remains a need for a massage apparatus capable of vibrating or oscillating in a variety of different directions and at a variety of different speeds or frequencies. Particularly, there remains a need for a massage apparatus that allows independent selection of such directions and frequencies of oscillation.

SUMMARY OF THE INVENTION

The purpose and advantages of the invention will be set forth in and apparent from the description and drawings that follow, as well as will be learned by practice of the invention. Additional advantages of the invention will be realized and attained by the elements of the apparatus and method particularly pointed out in the appended claims.

To achieve these and other advantages and in accordance with the purpose of the invention, as embodied and broadly described herein, a new and useful massage apparatus having a base structure capable of being supported by the hand of a user is provided. In accordance with one aspect of the invention, the base structure includes a first section to be positioned proximate a central portion of the hand and a second section to be positioned proximate a distal portion of the hand. The second section of the base structure is hingedly connected to the first section for articulated movement therebetween so as to correspond to movement of the distal portion of the hand relative to the central portion of the hand.

Preferably, and as embodied herein, the base structure is a housing having a first surface to be located adjacent the hand of the user and a second surface opposite the first surface. To accommodate this interaction with the user's hand, as well as with the surface on which the massage is to be applied, a resilient pad preferably is provided on at least one of these surfaces. Additionally, a connector is provided to couple the massage apparatus releasably with the hand of the user. The connector may include at least one flexible member extending from the base structure to encircle the user's hand, although a separate flexible member for each section of the base structure is preferred. To further assist in engagement of the user's hand with the massage apparatus, a lip extending from the base structure and shaped to conform substantially to the distal portion of the hand also is provided.

The massage apparatus also includes a driving device to oscillate the base structure in at least one direction. Preferably, however, the driving device is mounted on the second section of the base structure so as to be proximate the distal portion of the user's hand. In accordance with another aspect of the present invention, the base structure of the hand-held massage apparatus is oscillated in at least two different directions. A controller is provided to control operation of the driving device; preferably so as to control the frequency in which the driving device oscillates the base structure in the first direction and independently control the frequency in which the driving device oscillates the base structure in the second direction.

The driving device embodied herein includes a first drive motor having a first eccentric member rotatably attached thereto so as to oscillate the base structure in the first direction upon rotation of the first eccentric member by the first drive motor. Similarly, a second drive motor having a second eccentric member rotatably attached thereto so as to oscillate the base structure in the second direction upon rotation of the second eccentric member by the second drive motor. When using electrically-operated drive motors, the controller preferably includes at least one electrical switch to control an electrical supply to the drive motors, preferably, in combination with a selection of resistors to control the frequency in which the driving device oscillates the base structure in the first direction and in the second direction. Alternative driving devices and controllers may be used.

It is to be understood that both the foregoing general description and the following detailed description are exemplary and provided for purposes of explanation only, and are not restrictive of the invention, as claimed.

BRIEF DESCRIPTION OF THE DRAWINGS

The accompanying drawings, which are incorporated in and constitute a part of this specification, illustrate the preferred embodiment of the invention, and together with the description, serve to explain the principles of the invention.

FIG. 6 is a full view of one embodiment of a flexible member used for the massage apparatus of the present invention.

FIG. 7 is the bottom view of the massage apparatus shown in FIG. 5, with the lower half of the first and second sections removed.

DETAILED DESCRIPTION OF THE PREFERRED EMBODIMENT

Figure 1A:
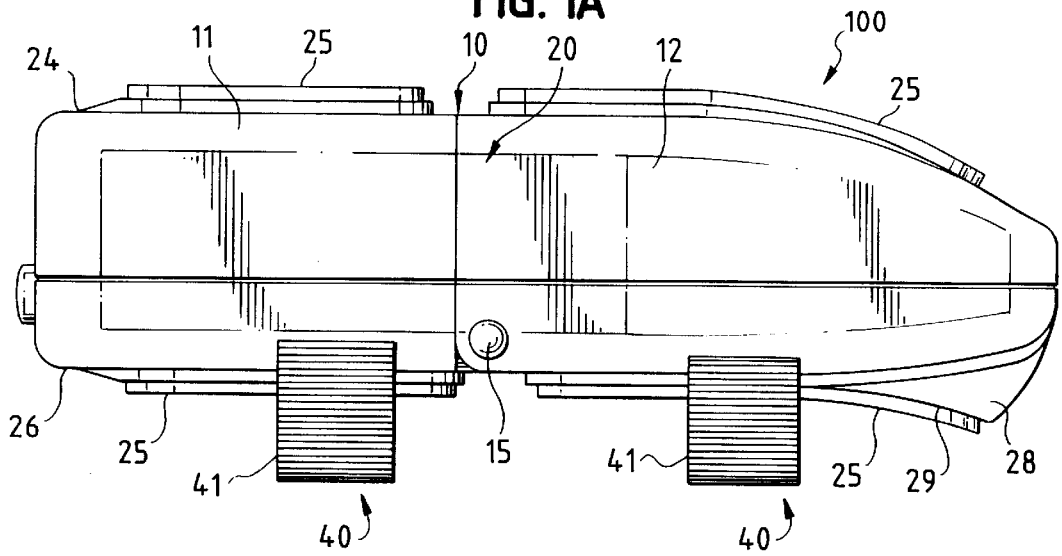
FIG. 1A is a side view of a representative embodiment of the massage apparatus of the present invention, when in a planar configuration.

Reference will now be made in detail to the present preferred embodiment of the massage apparatus of the invention, examples of which are illustrated in the accompanying drawings. Wherever possible, the same reference characters will be used throughout the drawings to refer to the same or like parts. The method of using the present invention will be described in conjunction with the detailed description of the massage apparatus.

The massage apparatus of the present invention generally includes a base structure and a driving device to oscillate the base structure. A controller also is provided to control operation of the driving device. Particularly, the base structure is configured and sized so as to be capable of being supported by the hand of the user. If appropriately sized the base structure may be grasped within the palm of the user's hand; however, a connector preferably is provided to attach the base structure to the user's hand for use as will be described further. For purpose of illustration and not limitation, FIGS. 1–7 show a representative embodiment of the massage apparatus of the present invention, which is designated generally by reference character 100.

In accordance with one aspect of the invention, the base structure 10 includes a first section 11 and a second section 12. The first section 11 is configured to be positioned proximate a central portion of the user's hand, such as either the palm or the back of the hand. The second section 12 is configured to be positioned proximate a distal portion of the hand, such as along the fingers. Further in accordance with the invention, the second section 12 of the base structure 10 is hingedly connected to the first section 11 for articulated movement therebetween. In this manner, and with the first section 11 positioned proximate the central portion of the hand, the second section 12 of the base structure 10 can move or pivot so as to correspond to movement of the distal portion of the hand relative to the central portion of the hand.

Articulated movement of the second section 12 of the base structure 10 relative the first section 11 is best demonstrated by the representative embodiment shown in FIGS. 1A and 1B; collectively hereinafter referred to as FIG. 1 except where referenced individually. Particularly, FIG. 1A shows a side view of the massage apparatus 100 embodied herein with the base structure 10 in a substantially planar configuration such that the second section 12 is aligned with the first section 11. For example, and with the massage apparatus 100 supported by the user's hand, the base structure 10 would be in the planar configuration of FIG. 1A when the user's hand is flat; that is, with the fingers outstretched. This planar configuration is beneficial when it is desired to apply a massage using the full surface of the hand or the upper surface 24 of the base structure housing 20, as will be described.

Figure 1B:
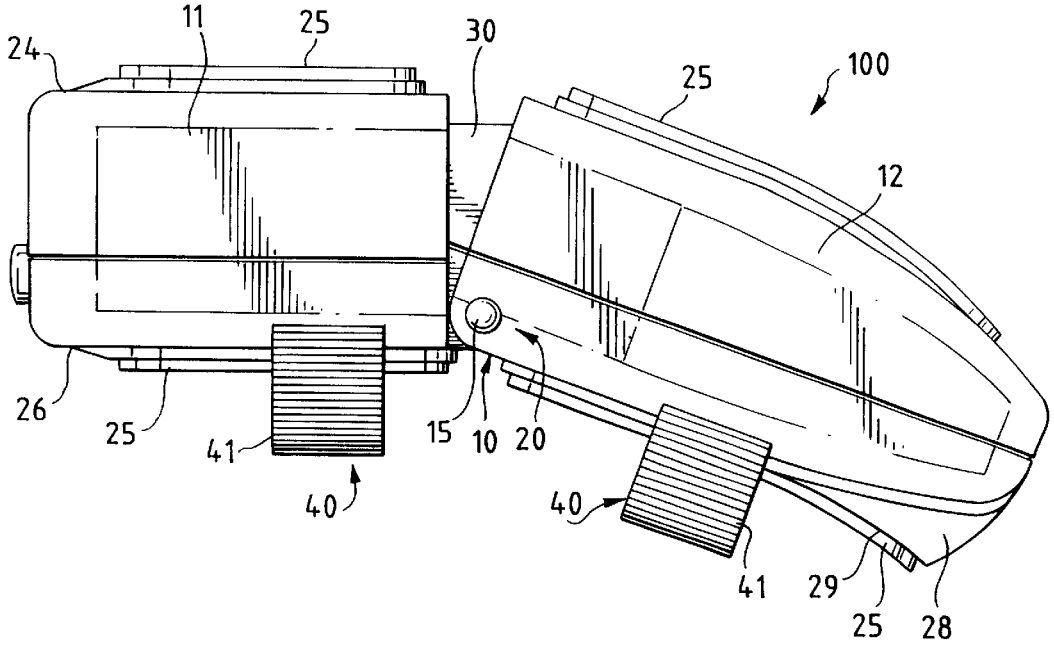
FIG. 1B is a side view of the massage apparatus shown in FIG. 1A, when in an articulated configuration.
Figure 2:
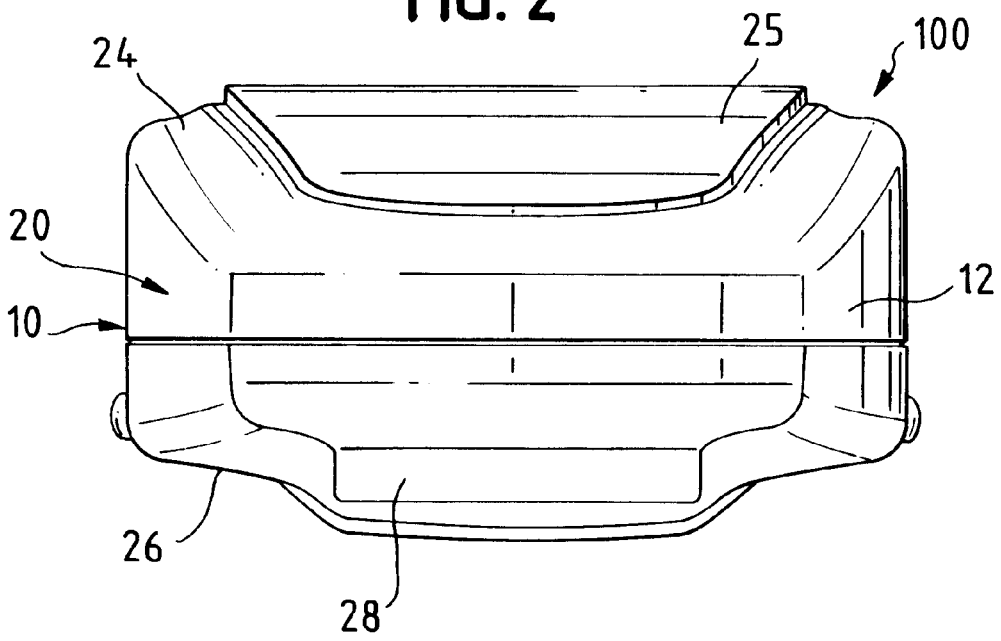
FIG. 2 is a front view of the massage apparatus shown in FIGS. 1A and 1B, with the flexible members removed.
Figure 3:
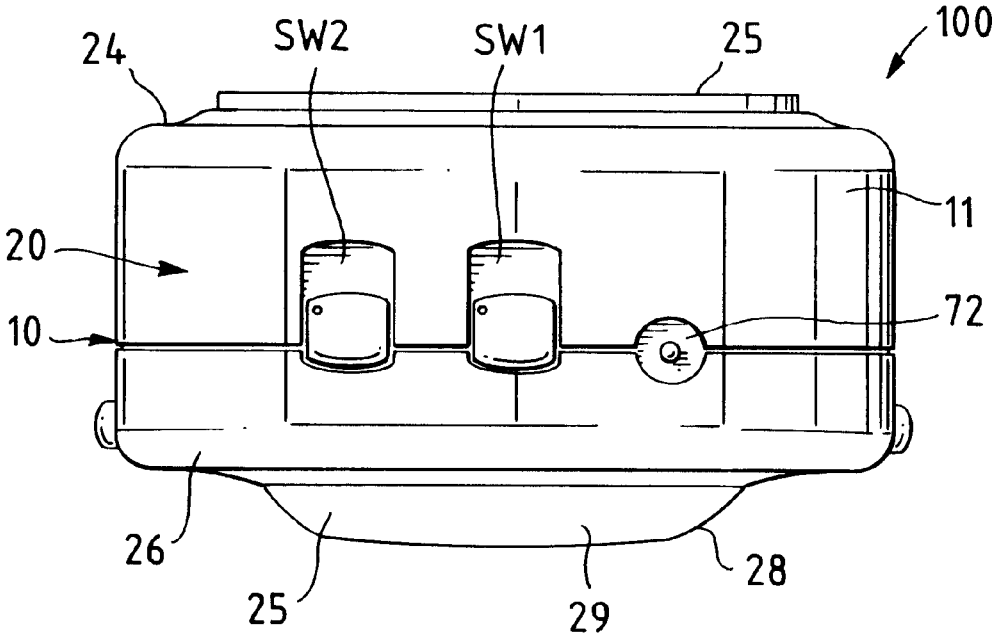
FIG. 3 is a back view of the massage apparatus shown in FIGS. 1A and 1B, with the flexible members removed.
Figure 4:
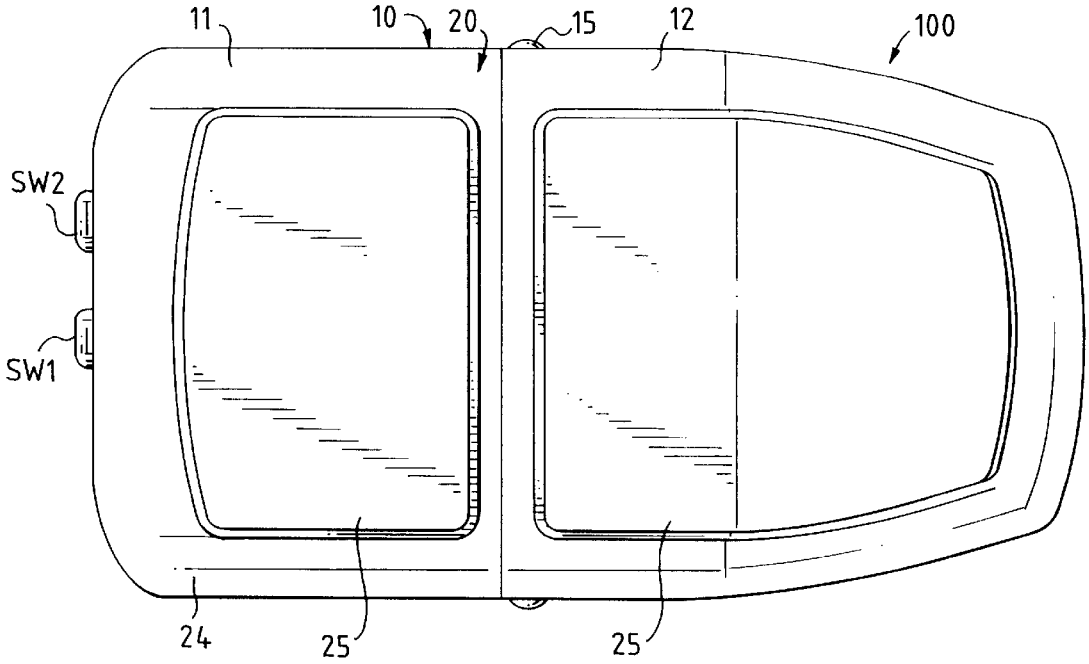
FIG. 4 is a top view of the massage apparatus shown in FIGS. 1A and 1B.

FIG. 1B shows a side view of the massage apparatus 100 embodied herein with the second section 12 of the base structure 10 articulated relative to the first section 11. That is, FIG. 1B shows the second section 12 angled downward relative to the first section 11. This articulated configuration would occur, for example, when the massage apparatus 100 is coupled with the back of the user's hand and the user's fingers are curled or closed toward the palm in a grasping or caressing motion. In this manner, and as described further below, a greater amount or portion of the oscillatory energy of the driving device 50 would be directed toward the distal portion or fingers of the user's hand.

In addition to such hand held use, it also should be understood that alternative uses of the massage apparatus are further enhanced by the present invention. For example, the massage apparatus can be placed on a floor, either in its planar configuration or in its articulated configuration, for massaging applications to the user's foot. The massage apparatus also can be positioned in a chair, either in its planar configuration or in its articulated configuration, for massaging applications to the lower back or the like. The configuration in which the massage apparatus is positioned will depend upon the application and concentration desired.

As shown in FIGS. 1–7, for purpose of illustration and not limitation, the base structure 10 embodied herein is a housing 20 suitably sized to be supported by the user's hand. The housing 20 embodied herein generally includes an outer wall 21 having a compartment 22 defined therein. The driving device of the massage apparatus 100 is mounted within the compartment 22 for protection and consolidation. A conventional driving device may be provided to oscillate the base structure 10 in a single direction, or a driving device capable of multi-directional oscillations may be provided as will be described further below. Rather than using a housing that provides complete enclosure, however, an open structure may be used if desired.

Figure 5:
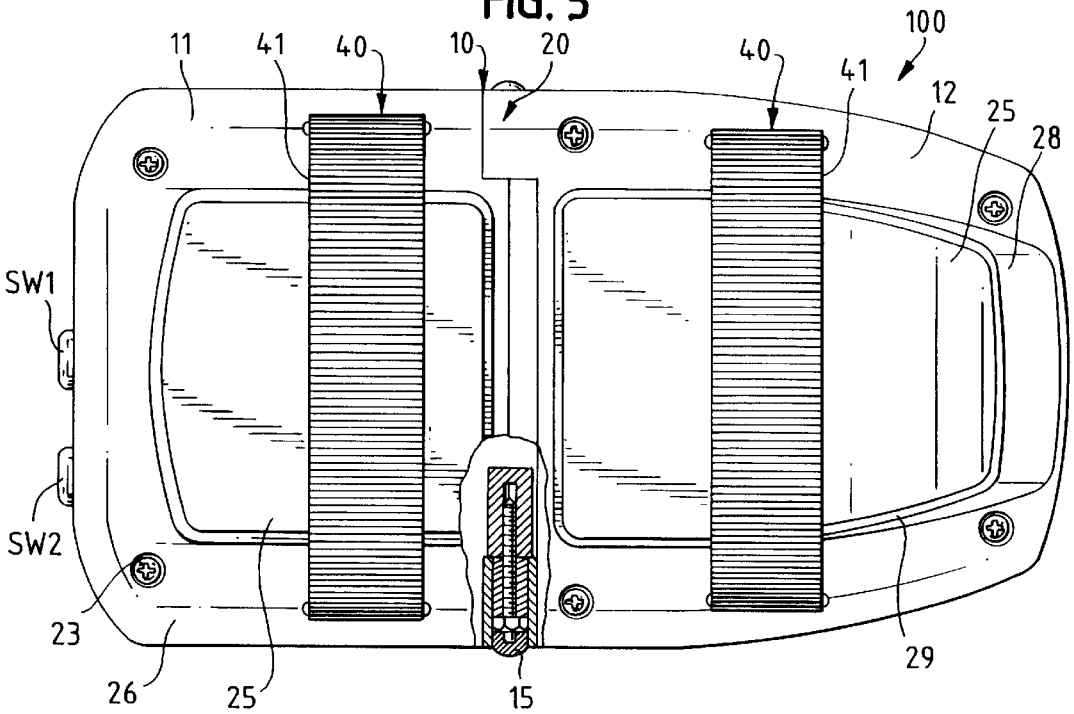
FIG. 5 is a bottom view of the massage apparatus shown in FIGS. 1A and 1B, with a fragmentary section showing one embodiment of a hinged connection.

To facilitate the articulated movement of the base structure 10, and in accordance with the present invention, the base structure housing 20 includes a second section 12 hingedly connected to a first section 11 as previously noted. For example, FIG. 5 shows that the first and second sections 11,12 of the base structure housing 20 are connected by a pin and bushing assembly 15 for such articulated movement therebetween, although any known hinged connection may be used. A sleeve extension 30 also is provided between the first and second sections 11,12 of the base structure housing 20 embodied herein. FIG. 7 shows the sleeve extension 30 formed integrally with the second section 12 and received by the first section 11. Alternatively, the sleeve extension 30 may be formed integrally the first section 11 so as to be received by the second section 12, or the sleeve extension 30 may be formed as a separate member and positioned between both the first and second sections 11,12.

As best shown in FIG. 1B, this sleeve extension 30 maintains substantial enclosure of the compartment 22 even when the second section 12 of the base structure housing 20 is fully articulated relative to the first section 11. Additionally, and in accordance with the preferred embodiment, the sleeve extension 30 also includes a stop member 32 to engage a peripheral flange 31 of the receiving section. For example, and as shown in FIG. 7, the first section 11 includes inwardly-directed flanges 31, while the second section 12 includes a sleeve extension 30 having outwardly-directed stop members 32 that are angled relative to the flanges 31. With the sleeve extension 30 received by the first section 11, articulated movement of the second section 12 relative to the first section 11 is limited by engagement of the stop member 32 against the peripheral flange 31.

The housing 20 is constructed of a light-weight, durable material. Although plastic is preferred, similar materials of suitable characteristics may be used. Depending upon the material and desired shape, a variety of known construction processes may be used, including injection molding, stamping, casting or vacuum forming techniques. Construction of the housing 20 is further simplified, however, by forming the first and second sections 11,12 each with separable halves as evident in FIGS. 1–3. These separable halves may then be assembled using snap-fit connections, welding, adhesives, or conventional fasteners 23 as shown in FIG. 5. The overall dimensions of the base structure 10 generally should not exceed about 8 inches in length and about 5 inches in width, although dimensions of approximately 6½ inches by 4 inches are preferred. Likewise, the height of the housing 20 should be less than about 4 inches, although a height of no more than about 2½ inches is preferred.

The housing 20 includes an upper surface 24 and a lower surface 26. Depending upon the desired use of the massage apparatus 100, one of these two surfaces generally will be located adjacent the user's hand. For example, and in the preferred use of the massage apparatus 100, the lower surface 26 of the housing 20 is located against the back of the user's hand such that a massage may be applied by the user's exposed fingers, and palm if desired. Alternatively, the lower surface 26 may be located against the palm of the user's hand such that the upper surface 24 of the massage apparatus 100 is used for applying the massage. It also is possible, if desired, to grip the massage apparatus 100 with the upper surface 24 located adjacent the user's palm. In this manner, the nose or lip 28 of the housing 20 may be used to apply a localized massaging action through oscillation of the base structure 10. As previously noted, it also is possible to use the massage apparatus of the present invention supported on a floor, chair or similar structure with either the upper or lower surface 24,26 exposed for massaging applications.

To accommodate this interaction with the user's hand, as well as with the surface on which the massage is being applied, a resilient pad 25 preferably is provided on at least one of either the upper or lower surfaces 24,26 of the housing 20. For example, it may be desirable to provide a resilient pad 25 only on the upper surface 24 of the housing 20 so as to reduce cost of construction, or to provide a resilient pad 25 only on the lower surface 26 of the housing 20 if use of the upper surface 24 is not desired. More preferably, however, and as shown in FIGS. 1–7, resilient pads 25 are provided on both the upper and lower surfaces 24,26 of the housing 20. These resilient pads 25 preferably are formed separately of a rubber or synthetic foam or similarly pliable material that is capable of transmitting the oscillatory energy with minimal absorption. One such suitable material is commonly known and available as EVA foam. These resilient pads 25 are then attached to the desired surface using a conventional adhesive, bonding or fastening technique. Alternatively, it is possible to overmold or otherwise directly apply a sufficiently pliable material onto the desired surface area. It also is preferred, as shown in FIGS. 1–7, to contour the housing 20 appropriately for aesthetics.

In a preferred embodiment of the present invention, a connector 40 is provided to couple the massage apparatus 100 releasably with the hand of the user. The connector 40 generally extends from the base structure 10, and may be formed integrally with the base structure 10 or provided as a separate element. For example, the connector 40 may include a flexible member 41 extending from the base structure 10 to encircle or otherwise engage a portion of the user's hand. Known flexible members for similar applications include torsion springs, elastic straps, and flexible webbing having an adjustable buckle or hook-and-loop fastener.

In the preferred embodiment of the invention, as shown in FIG. 6, the flexible member 41 includes the combination of a core band 42 of elastic material and a surrounding watchband spring 44 made of metal or the like. FIGS. 1 and 5 show that the flexible member 41 is anchored to opposite side edges of the base structure 10 to form a harness-like assembly against the lower surface 26 of the housing 20. The massage apparatus 100 is held against, and thereby supported on and coupled with, the user's hand when the user's hand is positioned between the flexible member 41 and the lower surface 26 of the housing 20. Additionally, and as further shown in FIGS. 1 and 5, at least one such flexible member 41 is provided on each section of the base structure 10. That is, the connector 40 of the massage apparatus 100 embodied herein includes a first flexible member 41 extending from the first section 11 of the base structure 10 to engage the central portion of the hand, and a second flexible member 41 extending from the second section 12 to engage the distal portion of the hand. This configuration further assists articulated movement of the second section 12 relative to the first section 11 when the fingers or distal portion of the hand are moved relative the central portion of the hand.

As shown in FIGS. 1 and 5, the massage apparatus 100 embodied herein also includes a lip 28 extending from the base structure 10 and shaped to conform substantially to the distal portion of the hand. Specifically, although not by limitation, FIG. 1 shows the lip 28 extending from the lower surface 26 of the housing 20 and including a gradual arcuate surface 29 against which the fingers or distal portion of the user's hand are engaged. Depending upon its shape, the lip 28 also may be used to provide more localized massaging applications when desired. The lip 28 of the massage apparatus 100 embodied herein is formed integrally as part of the housing 20 and, preferably, coated with a resilient pad 25 for comfort. Alternatively, the lip 28 may be constructed as a member separate from the housing 20, such as by shaping the resilient pad that is provided on the lower surface 26 of the second section appropriately to include a desired portion of increased thickness.

The base structure 10 of the massage apparatus 100 embodied herein, and set forth above, therefore allows greater versatility and comfort for the user as well as the recipient of the massage. As previously noted, the massage apparatus 100 includes a driving device to oscillate the base structure 10. By mounting the driving device on the second section 12 of the base section, the versatility of the massage apparatus 100 is even further enhanced. That is, when the base structure 10 is in the planar configuration of FIG. 1A, the driving device 50 generally will oscillate both the first and second sections 11,12 of the base structure 10 such that a larger massaging surface is provided. With the driving device 50 mounted on the second section 12 and the base structure 10 in the articulated configuration of FIG. 1B, however, a greater amount or portion of the oscillatory energy will be directed to the second section 12 of the base structure 10. Such concentrated oscillation will be transferred more effectively to the lip 28 or to the distal portion of the user's hand, and thus to the recipient of the massage, as desired.

In accordance with another aspect of the invention, a driving device is provided to oscillate a hand-held base structure in first and second different directions. Operation of the driving device is controlled by a controller. Particularly, and in accordance with a preferred embodiment of the present invention, the controller is capable of controlling the frequency in which the driving device oscillates the base structure in a first direction and, independently, controlling the frequency in which the driving device oscillates the base structure in a second direction, as will be described.

FIG. 7 shows, for purpose of illustration and not limitation, the various components of the driving device 50, as well as the controller 60, embodied herein. Generally, the driving device 50 embodied herein includes a first drive motor 51 and a second drive motor 52. Each drive motor includes a rotatable shaft 55 defining an axis of rotation. Attached to the rotatable shaft 55 of the first drive motor 51 is a first eccentric member 53. Rotation of the first eccentric motor thereby oscillates the base structure 10 in a first direction, which is defined by a plane perpendicular to the axis of rotation of the first drive motor 51. Similarly, a second eccentric member 54 is attached to the rotatable shaft 55 of the second drive motor 52 such that rotation of the second eccentric member 54 oscillates the base structure 10 in a second direction, which is defined by a plane perpendicular to the axis of rotation of the second drive motor 52. A bearing member or similar member, such as a felt seal, may be provided on each rotatable shaft 55 adjacent the corresponding eccentric member 53,54 to enhance performance.

As noted above, and in accordance with this aspect of the invention, the driving device 50 is configured to oscillate the base structure 10 of the massage apparatus 100 in at least two different directions independently. When using separate drive motors, this is accomplished by arranging the first drive motor 51 and eccentric member 53 to oscillate the base structure 10 in a direction different than that of the second drive motor 52 and eccentric member 54; preferably, although not necessarily, the drive motors are arranged perpendicular to each other. For example, and as shown in FIG. 7, the first drive motor 51 is arranged such that rotation of the first eccentric member 53 oscillates the base structure 10 in a transverse or sideways direction, as demonstrated by arrow A. The second drive motor 52 is arranged such that rotation of the second eccentric member 54 oscillates the base structure 10 in a longitudinal or back-and-forth direction, as demonstrated by arrow B. It also should be understood that, when using a drive motor and rotating eccentric member configuration, oscillation occurs in a circular manner about and in a plane perpendicular to the axis of rotation; hence, the first and second drive motors 51,52 shown in FIG. 7 both oscillate the base structure 10 in a vertical or up-and-down direction during rotation of the eccentric members.

Any of a variety of known drive motors and eccentric members may be used for the driving device 50 of the present invention; the particular model being dependent upon the operational parameters desired. Preferably, and as described in further detail below, the first and second drive motors 51,52 are operated by a DC power supply 70 and differ in operating speeds so as to oscillate the base structure 10 at different frequencies in the first and second directions, respectively. Such drive motors 51,52 preferably are mounted resiliently to the base structure 10 using foam members 56 or the like to minimize impact and wear between the components. Suitable drive motor and eccentric member assemblies are available from Mabuchi Motor of the Peoples Republic of China.

Alternative driving devices 50 may be used in accordance with the present invention if desired. For example, although not by limitation, a combination of solenoids capable of being rapidly pulsed or actuated may be used to oscillate the base structure 10 of the massage apparatus 100 in a variety of desired directions. That is, each solenoid includes a plunger that is reciprocally moved linearly between opposite positions, such that the linear movement of the plunger oscillates the base structure 10 in the same line of direction as the movement of the plunger. By providing two, three or more such solenoids aligned in different directions of movement, the base structure 10 can be oscillated accordingly.

A controller 60 is also provided in accordance with the invention to control operation of the driving device 50. In perhaps its simplest form, the controller 60 may include a switch assembly to selectively connect a power supply 70 to the driving device 50 so as to control whether or not oscillation will occur. In accordance with a preferred embodiment of the present invention, however, the controller 60 actually controls the frequency in which the driving device 50 oscillates the base structure 10. Even more preferably, the controller 60 controls the frequency in which the driving device 50 oscillates the base structure 10 in the first direction and independently controls the frequency in which the driving device 50 oscillates the base structure 10 in the second direction.

Figure 8:
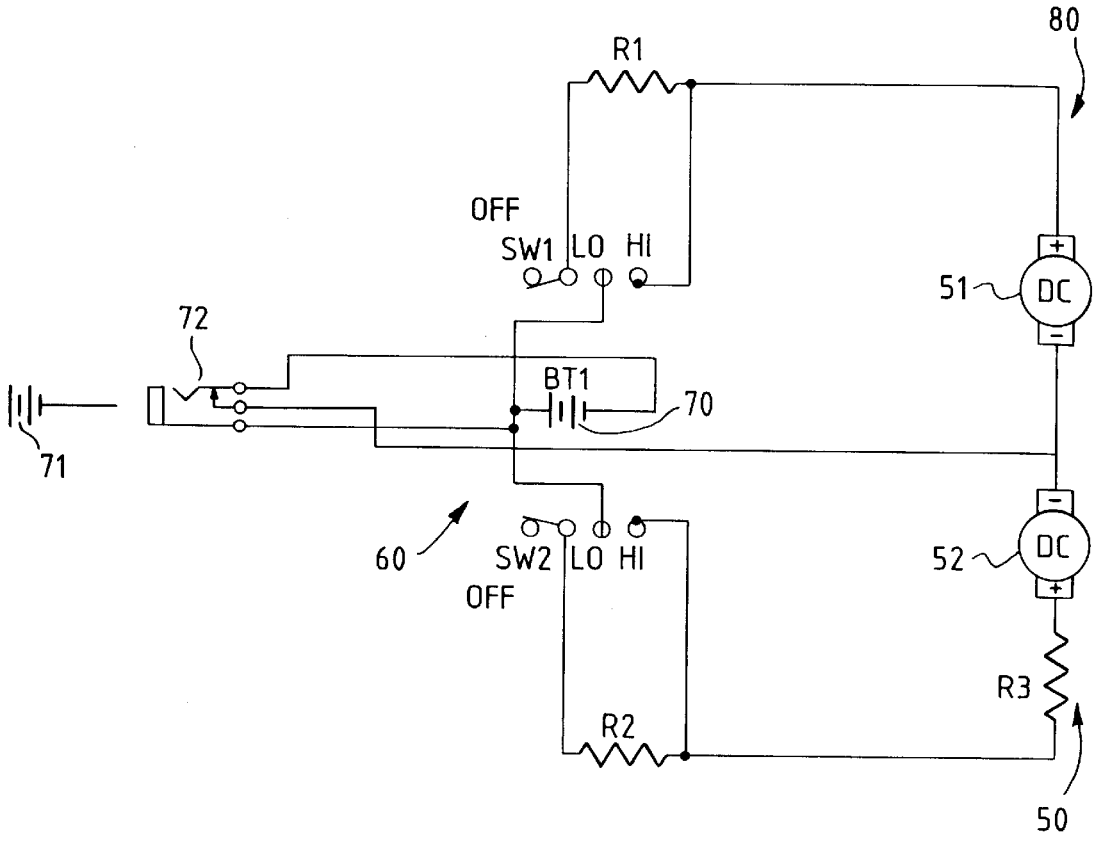
FIG. 8 is a schematic circuit diagram showing a representative embodiment of the electrical arrangement of the driving device and controller for the massage apparatus of the present invention.

With reference to the preferred embodiment of FIG. 7, and the corresponding schematic circuit diagram of FIG. 8, the controller 60 includes a first switch SW1 and a second switch SW2 to selectively connect a power supply 70 to the first drive motor 51 and the second drive motor 52, respectively and independently. Each switch SW1,SW2 is actuated manually to a desired operating selection. In this manner, the first drive motor 51 may be operated to oscillate the base structure 10 in the first direction without operating the second drive motor 52, and the second drive motor 52 may be operated to oscillate the base structure 10 in the second direction without operating the first drive motor 51. Further, both the first and second drive motors 51,52 may be operated simultaneously to create an undulating effect by oscillating the base structure 10 in both the first and second directions. FIG. 8 shows both switches SW1 and SW2 in the "OFF" position.

By independently controlling the frequency in which the drive motors oscillate the base structure 10, operation of the massage apparatus 100 is further enhanced. Additionally, it is preferable to alter the frequency in which the base structure 10 is oscillated in the first direction relative to the frequency in which the base structure 10 is oscillated in the second direction so as to enhance the resulting undulating movement and to prevent deleterious or counteracting effects that may occur if identical frequencies of oscillation were generated in both directions of oscillation. As embodied herein, such control is accomplished by providing a selection of resistors R through which the power supply 70 can be connected to the drive motors. The operating speed of each drive motor, and thus the frequency in which the base structure 10 is oscillated, will depend upon the number of resistors R selected, if any, and the corresponding resistance created. By providing a predetermined selection of resistors R, the amount of resistance for the first motor 51 and for the second motor 52, respectively, and thus the resulting frequencies of oscillation, can be staggered. The frequency of oscillation also can be staggered, as embodied herein, by using drive motors of different sizes and operating characteristics.

For example, but not by limitation, FIG. 8 shows a variety of resistor selections that may be used. Particularly, the controller 60 embodied herein includes three operating selections: OFF, LO and HI, although any number of operating selections may be provided as desired. The first drive motor 51 can be connected to the power supply 70 through a first resistor R1 when switch SW1 of the controller 60 is in the "LO" position, or connected directly to the power supply 70 with no resistor connected when switch SW1 is in the "HI" position. The second drive motor 52, on the other hand, may be connected to the power supply 70 through both a second resistor R2 and a third resistor R3 when switch SW2 of the controller 60 is in the "LO" position, or connected through only the third resistor R3 when switch SW2 is in the "HI" position. Although not required, the two DC drive motors shown in FIG. 8 are of different sizes and operating characteristics. In this manner, the frequency in which the first motor 51 and the second motor 52 each oscillate the base structure 10 will depend upon the resistance selected as well as the operating characteristics of the drive motor used. A variety of different combinations of oscillating directions and frequencies therefore can be selected.

Rather than using a selection of resistors to control operation of the driving device 50, alternative controllers also may be used within the scope of this invention. For example, and when using DC drive motors for the driving device 50, the power supply 70 for the DC drive motors may be provided by a number of conventional batteries and the controller 60 may include a switch assembly to select the number of batteries connected to each drive motor. Alternatively, each drive motor of the driving device 50 may be connected through a rheostat for more variable control of the oscillating frequency.

With regard to the power supply 70 for the driving device 50, the use of portable batteries BT1 is preferred for convenience. In the preferred embodiment of the massage apparatus 100, and as shown in FIGS. 7 and 8, a secondary power supply 71 such as a conventional AC wall outlet may be connected to recharge the portable batteries as needed. Rechargeable DC batteries, such as conventional nickel-cadmium batteries or the like, therefore are preferably provided on the base structure 10, and a jack receptacle 72 is provided to receive an adaptor from a transformer which, in turn, may be connected to the conventional AC power supply 71. As embodied herein, and as shown in FIG. 8, the electronic circuit 80 of the massage apparatus 100 may be configured to disconnect the batteries from the driving device 50 when the adaptor is received. In this manner, the driving device 50 cannot be operated directly from the secondary power supply 71. Alternatively, however, the electronic circuit 80 may be configured to allow operation of the driving device 50 using either the portable battery 70 or the secondary power supply 71, or by providing a secondary power supply 71 only, if desired.

Although reference has been made to the operation and features of the representative embodiment of the massage apparatus of the present invention for the purpose of explanation, it is understood that alternative operations and features likewise may be provided. It also will be apparent to those skilled in the art that various modifications and variations can be made in the design and construction of the massage apparatus without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A massage apparatus for hand-held use, the massage apparatus comprising:

a base structure to be supported by a hand of a user, the base structure including a first section to be positioned proximate a central portion of the hand and a second section to be positioned proximate a distal portion of the hand, the second section of the base structure being hingedly connected to the first section for articulated movement therebetween so as to correspond to movement of the distal portion of the hand relative to the central portion of the hand;

a driving device mounted on the base structure to oscillate the base structure in at least a first direction parallel to the plane of the hand; and a controller to control operation of the driving device.

2. The massage apparatus of claim 1, wherein the driving device further oscillates the base structure in a second direction different from the first direction and parallel to the hand.

3. The massage apparatus of claim 2, wherein the controller controls the frequency in which the driving device oscillates the base structure in the first direction and independently controls the frequency in which the driving device oscillates the base structure in the second direction.

4. The massage apparatus of claim 2, wherein the driving device includes a first drive motor having a first eccentric member rotatably attached thereto so as to oscillate the base structure in the first direction upon rotation of the first eccentric member by the first drive motor and a second drive motor having a second eccentric member rotatably attached thereto so as to oscillate the base structure in the second direction upon rotation of the second eccentric member by the second drive motor.

5. The massage apparatus of claim 4, wherein the controller including a switch assembly to control a power supply to the first drive motor and to the second drive motor.

6. The massage apparatus of claim 1, further comprising a connector extending from the base structure to couple the massage apparatus releasably to the hand of the user.

7. The massage apparatus of claim 6, wherein the connector includes a first flexible member extending from the first section of the base structure to engage the central portion of the hand, and a second flexible member extending from the second section of the base structure to engage the distal portion of the hand.

8. The massage apparatus of claim 1, wherein the base structure is a housing having a first surface to be located adjacent the hand when the massage apparatus is releasably connected thereto, and a second surface opposite the first surface, the second surface having a resilient pad thereon.

9. The massage apparatus of claim 8, wherein the base structure further includes a resilient pad on the first surface of the housing.

10. The massage apparatus of claim 1 further including a lip extending from the base structure and shaped to conform substantially to the distal portion of the hand.

11. The massage apparatus of claim 1, wherein the base structure is a housing having a compartment defined therein, the housing including a sleeve extension between the first section and the second section of the base structure to maintain substantial enclosure of the compartment.

12. A massage apparatus for hand-held use, the massage apparatus comprising:

a base structure to be supported by a hand of a user;

a driving device mounted on the base structure to oscillate the base structure in a first direction and to oscillate the base structure in a second direction different from the first direction, wherein said first and second directions are parallel to the hand; and a controller to control operation of the driving device, the controller controlling oscillation of the base structure by the driving device in the first direction, wherein the first direction is parallel to the hand, and independently controlling oscillation of the base structure by the driving device in the second direction, wherein the second direction is parallel to the plane of the hand.

13. The massage apparatus of claim 12, wherein the controller controls the frequency in which the driving device oscillates the base structure in the first direction and independently controls the frequency in which the driving device oscillates the base structure in the second direction.

14. The massage apparatus of claim 12, wherein the driving device includes a first drive motor having a first eccentric member rotatably attached thereto so as to oscillate the base structure in the first direction upon rotation of the first eccentric member by the first drive motor and a second drive motor having a second eccentric member rotatably attached thereto so as to oscillate the base structure in the second direction upon rotation of the second eccentric member by the second drive motor.

15. The massage apparatus of claim 14, wherein the controller includes a switch assembly to control a power supply to the first drive motor and to the second drive motor.

16. The massage apparatus of claim 15, wherein the switch assembly includes a selection of resistors to control the frequency in which the driving device oscillates the base structure in the first direction and in the second direction.

17. A massage apparatus comprising:

a base structure including a first section and a second section hingedly connected to the first section for articulated movement therebetween;

a driving device mounted on the second section of the base structure to oscillate the base structure in a first direction parallel to the plane of the hand and to oscillate the base structure in a second direction different from the first direction and parallel to the plane of the hand; and a controller to control operation of the driving device, the controller controlling oscillation of the base structure by the driving device in the first direction parallel to the hand and independently controlling oscillation of the base structure by the driving device in the second direction parallel to the hand.

* * * * *